US011071895B2

(12) United States Patent
Oman

(10) Patent No.: US 11,071,895 B2
(45) Date of Patent: Jul. 27, 2021

(54) HOCKEY STICK AND HOCKEY STICK SHAFT WITH FIRST AND SECOND CURVES

(71) Applicant: Andrew Oman, Bloomington, MN (US)

(72) Inventor: Andrew Oman, Bloomington, MN (US)

( * ) Notice: Subject to any disclaimer, the term of this patent is extended or adjusted under 35 U.S.C. 154(b) by 0 days.

(21) Appl. No.: 14/931,024

(22) Filed: Nov. 3, 2015

(65) Prior Publication Data

US 2017/0120120 A1 May 4, 2017

(51) Int. Cl.
*A63B 59/70* (2015.01)
*A63B 60/34* (2015.01)
*A63B 102/24* (2015.01)

(52) U.S. Cl.
CPC ..... *A63B 59/70* (2015.10); *A63B 60/34* (2015.10); *A63B 2102/24* (2015.10); *A63B 2209/00* (2013.01); *A63B 2209/02* (2013.01)

(58) Field of Classification Search
CPC ..... A63B 59/14; A63B 59/70; A63B 60/34; A63B 2209/02
USPC ..... 473/561, 560, 446
See application file for complete search history.

(56) References Cited

U.S. PATENT DOCUMENTS 2,146,048 A 2/1939 Barnhart
3,062,549 A 11/1962 Duden
D213,838 S 4/1969 McAllister
3,489,412 A 1/1970 Franck et al.
3,563,546 A 2/1971 Dawe
4,172,594 A 10/1979 Diederich
D258,377 S 2/1981 Nordness et al.
4,358,113 A 11/1982 McKinnon et al.
4,452,451 A 6/1984 Dubreuil
4,537,398 A 8/1985 Salminen
4,544,157 A * 10/1985 Curtis ..... A63B 60/10 473/560
4,563,006 A 1/1986 Hollner
(Continued)

FOREIGN PATENT DOCUMENTS

CA 2221067 7/1999
CA 2246079 A1 3/2000
(Continued)

OTHER PUBLICATIONS

Thomas, Shane, Authorized Officer, US Patent Office; International Search Report and Written Opinion, dated Jan. 25, 2017, International Application No. PCT/US16/60404, 10 pages.
(Continued)

*Primary Examiner* — Eugene L Kim
*Assistant Examiner* — Christopher Glenn
(74) *Attorney, Agent, or Firm* — Fish & Richardson P.C.

(57) ABSTRACT

A hockey stick includes a shaft, which includes an upper portion, a lower portion, and a middle portion between the upper portion and the lower portion. The upper portion of the shaft transitions to the middle portion via a first curve, and the middle portion transitions to the lower portion via a second curve. The hockey stick also includes a blade extending from the lower portion. The upper portion is nonlinear with the lower portion, and a first plane defined by the lower portion and the middle portion is generally transverse to a second plane defined by the blade.

16 Claims, 10 Drawing Sheets

(56) References Cited

U.S. PATENT DOCUMENTS

| | | | | |
|---|---|---|---|---|
| 4,629,190 | A * | 12/1986 | Borgen | A63B 60/34 473/560 |
| 4,664,379 | A | 5/1987 | Melby | |
| 4,793,613 | A | 12/1988 | Hughes | |
| 4,795,153 | A * | 1/1989 | Thomas | A63B 53/007 473/316 |
| 4,799,682 | A | 1/1989 | Hughes | |
| 5,050,878 | A | 9/1991 | Deleris | |
| 5,263,711 | A | 11/1993 | Addis et al. | |
| 5,292,128 | A | 3/1994 | Solheim | |
| 5,429,352 | A | 7/1995 | Leclerc | |
| 5,456,463 | A | 10/1995 | Dolan et al. | |
| 5,542,666 | A | 8/1996 | Chou | |
| 5,582,405 | A | 12/1996 | Montgomery | |
| 5,653,338 | A | 8/1997 | Tani | |
| 5,853,338 | A * | 12/1998 | Ubriaco | A63B 59/70 473/562 |
| 6,190,266 | B1 | 2/2001 | Pamias | |
| 6,364,792 | B1 * | 4/2002 | Evanochko | A63B 60/34 473/560 |
| 6,379,261 | B1 | 4/2002 | Hart | |
| 6,500,079 | B1 * | 12/2002 | Tucker, Sr. | A63B 49/08 473/513 |
| 7,232,385 | B2 | 6/2007 | David | |
| 7,232,386 | B2 | 6/2007 | Halko et al. | |
| 7,789,778 | B2 | 9/2010 | Goldsmith et al. | |
| 7,857,717 | B2 * | 12/2010 | Martin | A63B 69/0026 473/446 |
| 8,251,844 | B2 | 8/2012 | Cross et al. | |
| 8,292,762 | B2 | 10/2012 | Clancy | |
| 2007/0129187 | A1 | 6/2007 | Bedwell et al. | |
| 2009/0005197 | A1 * | 1/2009 | Mayer | A63B 59/70 473/560 |
| 2014/0171237 | A1 | 6/2014 | Crossley | |

FOREIGN PATENT DOCUMENTS

| | | |
|---|---|---|
| CA | 2697475 | 9/2011 |
| DE | 202005016730 | 3/2006 |

OTHER PUBLICATIONS

Non-final Office Action, U.S. Appl. No. 15/249,382, dated Apr. 7, 2017, 39 pages.

European Extended Search Report in European Application No. EP 16863006, dated Oct. 31, 2018, 8 pages.

International Preliminary Report on Patentability in International Application No. PCT/US2016/060404, dated May 8, 2018, 8 pages.

Unitied States Office Action in U.S. Appl. No. 15/249,382, dated Apr. 7, 2017, 39 pages.

Unitied States Office Action in U.S. Appl. No. 15/249,382, dated Oct. 20, 2017, 20 pages.

Unitied States Office Action in U.S. Appl. No. 15/249,382, dated Dec. 20, 2017, 3 pages.

Unitied States Office Action in U.S. Appl. No. 15/249,382, dated Mar. 14, 2018, 30 pages.

* cited by examiner

HOCKEY STICK AND HOCKEY STICK SHAFT WITH FIRST AND SECOND CURVES

TECHNICAL FIELD

This document generally describes hockey sticks and hockey stick shafts, and methods of making and using the hockey sticks and hockey stick shafts.

BACKGROUND

Ice hockey is a competitive sport played by players who skate on ice and attempt to shoot a rubber puck into an opponent's net, while preventing the opponent from shooting the puck into their net. A game involves two teams, each with five skaters (typically three forwards and two defense) and one goalie. The skaters generally skate up and down the ice, while the goalie typically remains near the net to prevent the puck from entering the net.

Skaters use a hockey stick (sometimes also called a "player's stick") to control the puck, shoot the puck, pass the puck to a teammate, receive a pass from a teammate, or steal the puck from the opponent. Goalies use a goal stick or goalie stick, which is typically larger, heavier, and has a different shape than a player's stick, to stop pucks directed toward the net and to play the puck away from the net.

The hockey stick or player's stick includes a shaft and a blade. A traditional hockey stick includes a shaft that is straight, without curves or bends. The hockey player or skater grips the hockey stick by the shaft, and uses the blade of the stick to contact the puck. In some examples, the shaft and the blade are integral and sold or marketed as a complete stick (a so-called "one-piece" hockey stick), while in other examples the shaft and the blade are sold separately and the blade can be attached to a lower portion of the shaft (to create a so-called "two-piece" hockey stick).

Hockey sticks have been constructed from a variety of materials. Historically, hockey sticks have been made of wood, but in recent years have been made from a variety of other materials, including aluminum, aramid fiber (e.g., Kevlar), fiberglass, carbon fiber, or other composite materials.

SUMMARY

This document generally describes hockey sticks and hockey stick shafts that include a first curve and a second curve in the shaft.

In a first general aspect, a hockey stick includes a shaft, where the shaft includes an upper portion, a lower portion, and a middle portion between the upper portion and the lower portion. The upper portion of the shaft transitions to the middle portion via a first curve, and the middle portion transitions to the lower portion via a second curve. The hockey stick also includes a blade extending from the lower portion. The upper portion is nonlinear with the lower portion, and a first plane defined by the lower portion and the middle portion is generally transverse to a second plane defined by the blade.

Various implementations may include one or more of the following. The upper portion and lower portion may be substantially parallel. A longitudinal axis of the upper portion and a longitudinal axis of the lower portion may intersect at an angle within a range of 0 degrees to 45 degrees. The first plane may be substantially orthogonal to the second plane. The middle portion may include a midpoint of the shaft. The lower portion may include a midpoint of the shaft. The second curve may include a midpoint of the shaft. The first curve may be in a first direction, and the second curve may be in a second direction that is generally opposite the first direction. The shaft has a generally S-shape. The first plane may be further defined by the upper portion. The shaft may be constructed of wood, metal, or a composite material, where the metal or composite material may be selected from aluminum, aluminum alloy, titanium, titanium alloy, fiberglass, Kevlar, Aramid material, carbon fibre, graphite, resin, fiber-reinforced polymer, or fiber-reinforced plastic. Each of the upper portion, middle portion, and lower portion may be substantially straight. The upper portion may include a first grip feature, and the middle portion may include a second grip feature. The lower portion may include a third grip feature. The upper portion may include a transverse curve near an end of the upper portion. The hockey stick may be a one-piece hockey stick. The blade may be releasably attached to the shaft. The first curve or the second curve may include two or more contiguous and straight shaft portions that define one or more angles between the two or more contiguous and straight shaft portions.

In a second general aspect, a hockey stick includes a shaft, where the shaft includes an upper portion, a lower portion substantially parallel to the upper portion, and a middle portion between the upper portion and the lower portion. The upper portion of the shaft transitions to the middle portion via a first curve, and the middle portion transitions to the lower portion via a second curve. The middle portion includes a midpoint of the shaft. The hockey stick also includes a blade extending from the lower portion. The upper portion is nonlinear with the lower portion, and a first plane defined by the lower portion and the middle portion is generally orthogonal to a second plane defined by the blade.

Some implementations may provide one or more of the following advantages: improved accuracy with wrist shots, improved accuracy with slapshots, improved accuracy with snap-shots, improved passing performance, improved pass-receiving performance, improved stickhandling performance, improved puck protection performance, improved backhand shooting and/or passing performance, improved faceoff performance, greater variety of potential hand positions along the shaft, better puck battle performance, improved velocity due to directing a larger percentage of shot energy in the direction of of the shot, easier to pick up a stick that is laying on the ice.

BRIEF DESCRIPTION OF THE DRAWINGS

Like reference symbols in the various drawings indicate like elements.

DETAILED DESCRIPTION

Described herein are hockey sticks and hockey stick shafts that include first and second curves in the shaft of the hockey stick, and methods of making and using the hockey sticks and hockey stick shafts. Before turning to a discussion of the hockey sticks and shafts with first and second curves, however, it will be helpful to briefly describe some aspects of traditional hockey sticks and traditional hockey stick shafts, with reference to FIGS. 1A, 1B, and 1C.

Figure 1A:
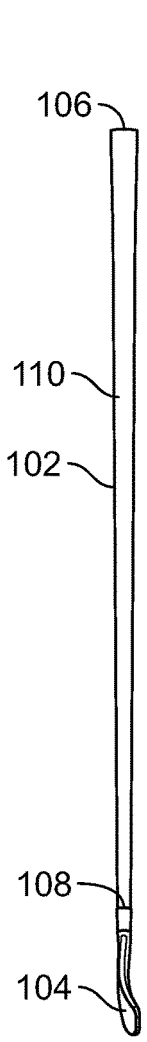
FIG. 1A (Prior Art)
FIGS. 1A, 1B, and 1C are a front view, a side view, and a top view, respectively, of a traditional hockey stick.
Figure 1B:
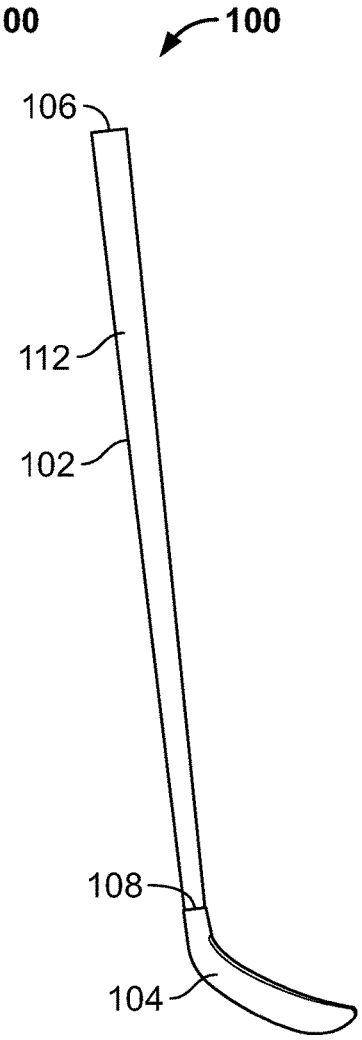
FIG. 1B (Prior Art)
Figure 1C:
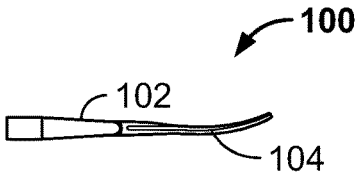
FIG. 1C (Prior Art)

FIGS. 1A, 1B, and 1C are a front view, a side view, and a top view, respectively, of a traditional hockey stick 100. The traditional hockey stick 100 includes a traditional shaft 102 and a blade 104. The traditional shaft 102 is straight, without any bends or curves. For example, as can be seen in the front view of FIGS. 1A and 1*n* the side view of FIG. 1B, the traditional shaft 102 is generally straight or linear (e.g., considering the shaft 102 itself a line segment) between a top 106 of the shaft and a bottom 108 of the shaft 102. The traditional shaft 102 is straight or linear over the entire length of the traditional shaft 102.

The traditional shaft 102 includes four outer surfaces that extend the length of the traditional shaft: a front surface 110, a back surface (opposite the front surface 110, not shown), a left surface 112, and a right surface (opposite the left surface 112, not shown). Each of the four outer surfaces of the traditional shaft 102 may be individually contained within a respective plane (e.g., a flat, two-dimensional surface in Euclidean geometry). For example, the front surface 110 of the traditional shaft 102 may be entirely contained within a first plane, and the front surface 110 may be referred to as a planar surface; the back surface of the traditional shaft 102 may be entirely contained within a second plane, and the back surface may be referred to as a planar surface; the left surface 112 of the traditional shaft 102 may be entirely contained within a third plane, and the left surface 112 may be referred to as a planar surface; and the right surface of the traditional shaft 102 may be entirely contained within a fourth plane, and the right surface may be referred to as a planar surface. Each of the four outer surfaces that extend the length of the traditional shaft is a two-dimensional surface. In some examples, the edges between the surfaces are rounded, and in some examples the edges between the surfaces are not rounded.

The blade 104 extends from the shaft 102. In some examples, the blade 104 is curved to the left or to the right, and in other examples the blade 104 is generally straight. As can be seen in FIG. 1A, the depicted blade 104 is curved to the right when viewed via a front view, and as such the hockey stick 100 may be considered a "right-hand-shot" or "right-shot" stick, intended for use by players who grip the shaft 102 with their left hand near the top 106 of the shaft and with their right hand lower on the shaft. In the side view of FIG. 1B, the blade 104 figuratively curves "into the page." In examples where the blade is instead curved to the left (not shown) when viewed via a front view, the hockey stick may be considered a "left-hand-shot" or "left-shot" stick, intended for use by players who grip the shaft 102 with their right hand near the top 106 of the shaft and with their left hand lower on the shaft.

Figure 2A:
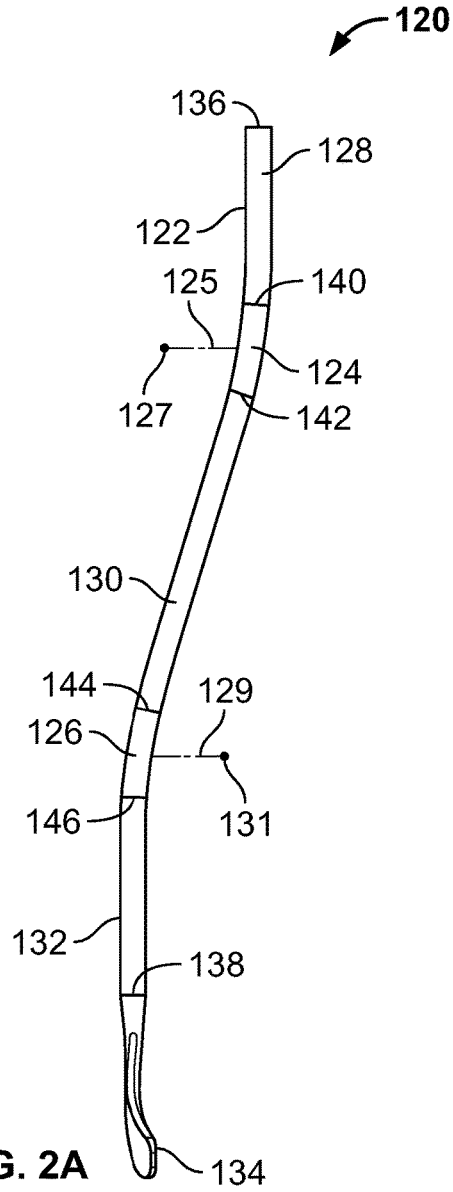
FIGS. 2A, 2B, and 2C are a front view, a side view, and a top view, respectively, of an example hockey stick.
Figure 2B:
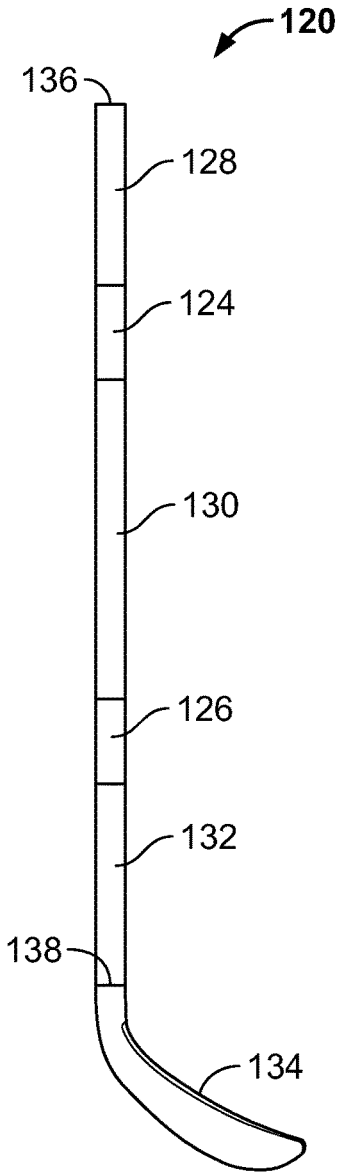
Figure 2C:
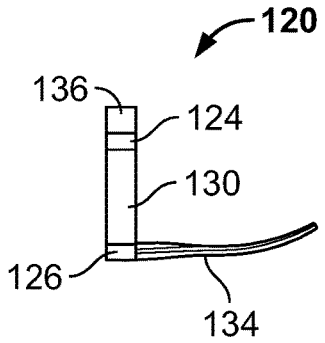

FIGS. 2A, 2B, and 2C are a front view, a side view, and a top view, respectively, of an example hockey stick 120. The example hockey stick 120 includes an example shaft 122 that includes a first curve 124 and a second curve 126. The example shaft 122 further includes an upper portion 128 of the shaft 122, a middle portion 130 of the shaft 122, and a lower portion 132 of the shaft 122, where the upper portion 128 and the middle portion 130 are separated by the first curve 124 of the shaft 122, and where the middle portion 130 and the lower portion 132 are separated by the second curve 126 of the shaft 122. The hockey stick 120 also includes a blade 134 that extends from the lower portion 132 of the shaft 122. The depicted blade 134 is curved to the right when viewed via a front view (e.g., FIG. 2A), and stick 120 is thus a right-shot stick.

In contrast to a shaft of a conventional hockey stick (e.g., shaft 102 of FIGS. 1A-1C), the shaft 122 is not straight, but rather includes first and second curves, as can be seen in the front view of FIG. 2A and in the top view of FIG. 2C, for example. For example, the shaft 122 includes the first curve 124 of the shaft 122 and the second curve 126 of the shaft 122. In some examples, the first curve 124 and the second curve 126 are oriented in generally opposite directions. In the side view of FIG. 2B, the first curve 124 figuratively curves "into the page," while the second curve 126 figuratively curves "out of the page." Stated another way, the first curve 124 may include a first radius of curvature 125 (shown as a dashed line in FIG. 2A), where a center of curvature 127 for the first curve 124 (or a center of the first radius of curvature) is "out of the page" in FIG. 2B, and the second curve 126 may include a second radius of curvature 129 (shown as a dashed line in FIG. 2A), where a center of curvature 131 for the second curve 126 (or a center of the second radius of curvature) is "into the page" in FIG. 2B. In some examples, the center of curvature 127 for the first curve 124 and the center of curvature 131 for the second curve 126 are on opposite sides of the middle portion 130 of the shaft 122. In some examples, the first radius of curvature 125 is equal to the second radius of curvature 129, so that the first curve 124 has generally equivalent curvature of the second curve 126, but in a generally opposite direction.

In general, the first curve 124 and the second curve 126 may have any appropriate curvature. In some examples, the curvature of the first curve 124 is defined by a first radius of curvature (of appropriate length), and the curvature of the second curve 126 is defined by a second radius of curvature (of appropriate length). In general, personal preference may determine an appropriate radius of curvature, where the radius may have any appropriate length from zero to infinity. In some examples, the radius of curvature has length zero (e.g., when the upper portion and the middle portion intersect and form an angle for the first curve, or when the middle portion and the lower portion intersect and form an angle for the second curve).

Figure 2D:
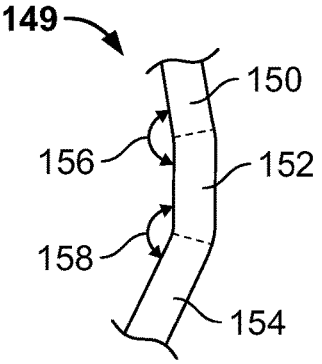
FIG. 2D is view of an example section of an example hockey stick shaft.

While the examples discussed herein refer to example curves (e.g., the first curve 124 and the second curve 126) of example hockey stick shafts, it will be understood that the example curved portions of the shaft described herein could alternatively be replaced with two or more straight or linear portions of the shaft, where the two or more straight or linear portions are configured to intersect at one or more angles (e.g., two contiguous straight portions that intersect at one angle; three contiguous straight portions that intersect at two angles; four contiguous straight portions that intersect at three angles, and so on), where the straight portions and angle(s) approximate a curve, for example. FIG. 2D is a view of an example section 149 of an example shaft, where section 149 may provide a curve (e.g., the first curve 126 or the second curve 128) for a shaft using contiguous straight portions that define one or more angles. Section 149 includes a first straight portion 150, a second straight portion 152, and a third straight portion 154, where the first, second and third straight portions 150, 152, 154 are contiguous. First straight portion 150 and second straight portion 152 define a first angle 156, and second straight portion 152 and third straight portion 154 define a second angle 158.

In some examples, the upper portion of the shaft and the middle portion of the shaft may intersect at an angle to form the first curve of the shaft, and the middle portion of the shaft and the lower portion of the shaft may intersect at an angle to form the second curve of the shaft.

Unlike the conventional hockey stick shaft (e.g., shaft 102), for example, shaft 122 is not straight or linear over the entire length of the shaft 122. In some examples, the shaft 122 is not generally straight or linear between a top 136 of the shaft 122 and a bottom 138 of the shaft 122. For example, the upper portion 128 of the shaft 122 is nonlinear with the middle portion 130 of the shaft 122, and the middle portion 130 of the shaft 122 is nonlinear with the lower portion 132 of the shaft 122, according to some implementations. Further, the upper portion 128 of the shaft 122 is nonlinear with the lower portion 132 of the shaft 122, according to some implementations.

Referring again to the front view of FIG. 2A, the first curve 124 begins at a bottom end 140 of the upper portion 128 and ends at top end 142 of the middle portion 130. The second curve 126 begins at a bottom end 144 of the middle portion 130 and ends at a top end 146 of the lower portion 132. In some examples, the upper portion 128 of the shaft 122 transitions to the middle portion 130 of the shaft 122 via the first curve 124, and the middle portion 130 of the shaft 122 transitions to the lower portion 132 of the shaft 122 via the second curve 126.

In some examples, the first curve 124 defines a first arc and the second curve 126 defines a second arc, where the second arc is generally opposite (e.g., in a direction opposite of) the first arc. In some examples, the second curve 126 is in a second direction that is generally opposite a first direction of the first curve 124. In some examples, one or more of the first curve 124 or the second curve 126 may define two or more (e.g., two, three, four, or more) arcs.

With reference again to FIG. 2A, the blade 134 extends from the shaft 122. In some examples, blade 134 is substantially identical to the blade 104 of FIGS. 1A-1C. The depicted blade 134 is curved to the right when viewed via a front view (e.g., FIG. 2A), and the example hockey stick 120 may therefore be appropriate for right-shot players, but in other examples the blade may instead be curved to the left (not shown), and appropriate for left-shot players. In the side view of FIG. 2B, the blade 134 figuratively curves "into the page." In some examples, the blade 134 may be substantially straight (not shown). In some embodiments, the example shaft 122 and blade 134 may be integral and the example hockey stick 120 may be a one-piece hockey stick. In some embodiments, the example hockey stick 120 may be a two-piece hockey stick, where the example shaft 122 and the blade 134 are initially separate from one another, and the blade 134 is attached at a lower portion of the shaft 122.

In some examples, each of the upper portion 128, the middle portion 130, and the lower portion 132 of the shaft 122 is generally straight or linear. For example, the upper portion 128 may be generally straight or linear (e.g., over the entire length of the upper portion 128), the middle portion 130 may be generally straight or linear (e.g., over the entire length of the middle portion 130), and the lower portion 132 may be generally straight or linear (e.g., over the entire length of the lower portion 132). In some examples, each of the upper portion 128, middle portion 130, and lower portion 132 is substantially straight.

In some examples, a length of the upper portion 128 is approximately the same as a length of the lower portion 132. In some examples, the lengths of the upper portion 128, lower portion 132, and middle portion 130 are all approximately the same. In some examples, lengths of two of the portions may be approximately the same and a length of the remaining portion may differ (e.g., length of upper and lower portions 128, 132 approximately same, length of middle portion 130 different; length of upper and middle portions 128, 130 approximately same, length of lower portion 132 different; or length of middle and lower portions 130, 132 approximately same, length of upper portion 128 different). Alternatively, each of the portions 128, 130, and 132 may have a length different from the other portions.

Figure 3:
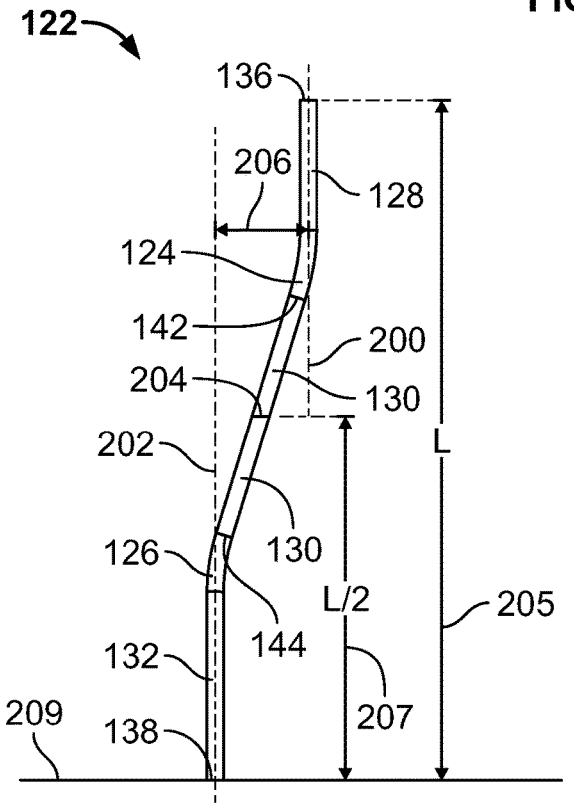
FIG. 3 is a front view of the example hockey stick shaft of FIG. 2A.

FIG. 3 is another front view of the example hockey stick shaft 122. In some examples, an upper portion 128 of the shaft 122 and a lower portion 132 of the shaft 122 may be substantially parallel. For example, a longitudinal axis 200 of the upper portion 128 may be substantially parallel and nonlinear with a longitudinal axis 202 of the lower portion 132, such that the axes 200 and 202 do not intersect. In some examples, the longitudinal axis 200 of the upper portion 128 and the longitudinal axis 202 of the lower portion 132 intersect (not shown) at an angle in the range of about 0 degrees to about 45 degrees, or in a range of about 0 degrees to about 30 degrees, or in a range of about 0 degrees to about 20 degrees, or in a range of about 0 degrees to about 10 degrees, or in a range of about 0 degrees to about 5 degrees.

The example hockey stick shaft 122 includes an offset 206 between the upper portion 128 of the shaft 122 and the lower portion 132 of the shaft 122. In various examples, the amount of offset 206 between the upper portion 128 of the shaft 122 and the lower portion 132 of the shaft 122 may be tailored during construction of the shaft 122 (or of the entire hockey stick) by varying one or more of a length of the middle portion 130 of the shaft 122, curvature of the first curve 124 or the second curve 126, or a length of the first curve 124 or the second curve 126. In some examples, the offset 206 is in a range of about 0" to about 18". In some examples, the offset 206 may be measured from the longitudinal axis 200 of the upper portion 128 at the bottom end 140 of the upper portion 128 orthogonal to the longitudinal axis 202 of the lower portion 132, as generally depicted in FIG. 3. Without limitation, example values for the offset 206 between the upper portion 128 of the shaft 122 and the lower portion 132 of the shaft 122 may be less than 1", about 1", about 2", about 3", about 4", about 5", about 6", about 7", about 8", about 9", about 10", about 11", about 12", about 13", about 14", about 15", about 16", about 17", about 18", or other appropriate offset amount. Traditional, straight hockey stick shafts, by contrast, have zero offset between upper and lower portions of the traditional shaft.

In some examples, the middle portion 130 of the shaft 122 includes a midpoint of the shaft. With reference again to FIG. 3, the shaft 122 has a length "L" 205 and a midpoint 204 at a distance of "L/2" (L divided by two) 207 from the bottom 138 of the shaft 122. The length 205 may be measured, for example, by orienting the lower portion 132 of the shaft 122 generally orthogonally with a surface 209, and measuring from the bottom 138 of the shaft (e.g., from the surface 209 with the bottom 138 of the shaft 122 resting on the surface 209) to the top 136 of the shaft 122. Similarly, the midpoint 204 may be a point on the shaft 122 a distance L/2 from the bottom 138 of the shaft 122 with the shaft 122 oriented as described above and as shown in FIG. 3.

In the example of FIG. 3, the middle portion 130 of the shaft 122 includes the midpoint 204 of the shaft 122. For example, the midpoint 204 is located between the top end 142 of the middle portion 130 and the bottom end 144 of the middle portion 130. While the midpoint 204 is shown in FIG. 3 as measured from the bottom 138 of the shaft 122, in other examples the midpoint 204 may be measured with respect to the top 136 of the shaft 122 (e.g., a distance L/2 from the top 136 of the shaft 122, not shown in FIG. 3). For a given length L 205 of the shaft 122, a point that is a distance L/2 207 from the bottom 138 of the shaft 122 (or from the top 136 of the shaft 122 in some examples) may be located in the middle portion 130 of the shaft 122, for example as shown in FIG. 3. FIG. 3 shows the midpoint 204 near the center of the middle portion 130, but in other examples the midpoint 204 may be closer to the top end 142 of the middle portion 130 or may be closer to the bottom end 144 of the middle portion 130 versus what is shown in FIG. 3. In other examples, the upper portion 128 of the shaft 122 may include the midpoint of the shaft, as will be described below with reference to FIG. 4A. In still other examples, the lower portion 132 of the shaft 122 may include the midpoint of the shaft, as will be described below with reference to FIG. 4B.

Figure 4A:
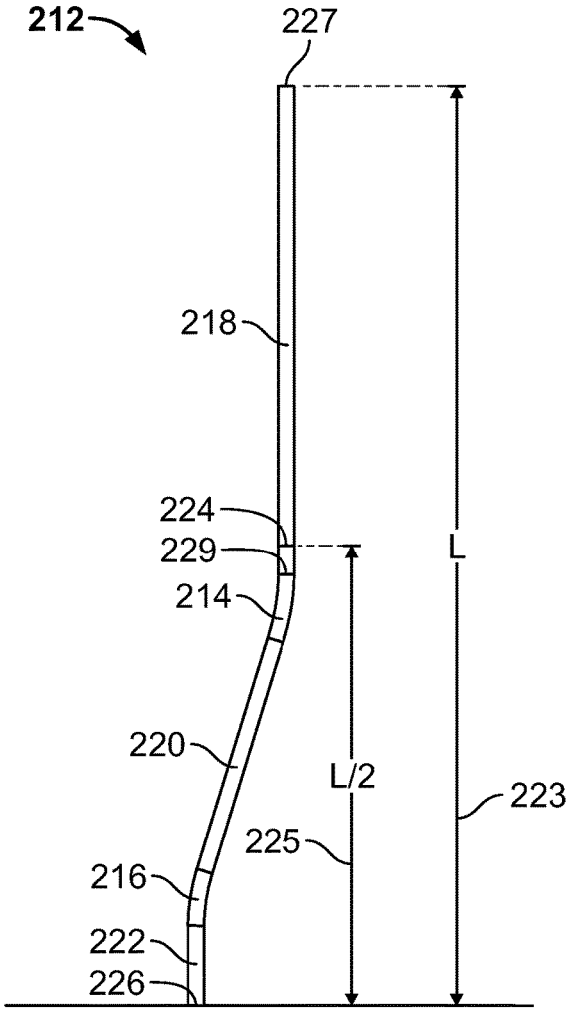
FIGS. 4A, 4B, 4C, and 4D are front views of various example hockey stick shafts.

FIG. 4A is a front view of an example hockey stick shaft 212 that includes a first curve 214 and a second curve 216. The example hockey shaft 212 includes an upper portion 218, a middle portion 220, and a lower portion 222. The example hockey shaft 212 has length L 223, and a midpoint 224, at a distance of L/2 225 from a bottom 226 of the shaft 212. In the example of FIG. 4A, the upper portion 218 of the shaft 212 includes the midpoint 224 of the shaft 212. For example, the midpoint 224 of the shaft 212 is located between a top 227 of the shaft 212 and a bottom end 229 of the upper portion 218 of the shaft 212.

Figure 4B:
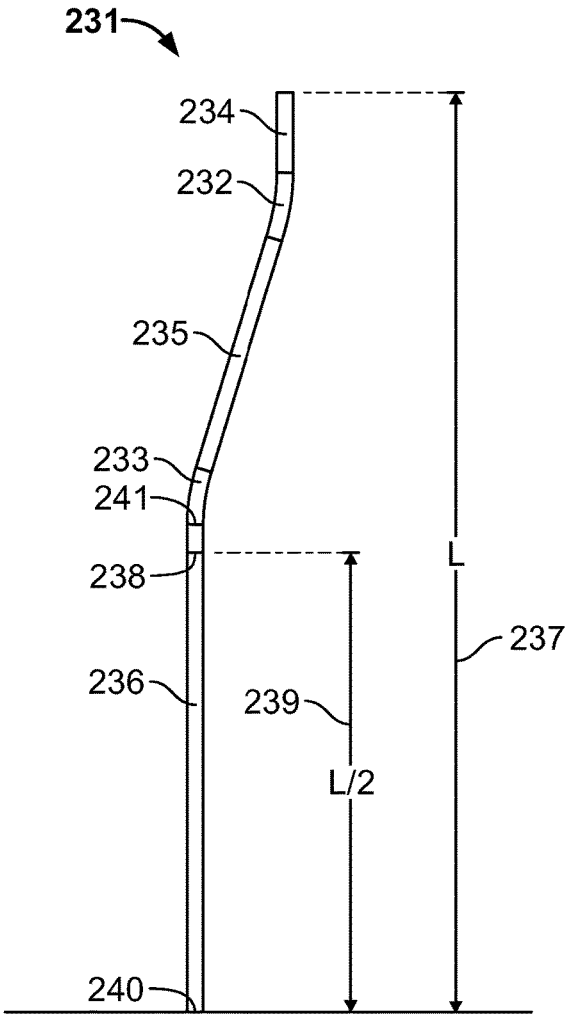

FIG. 4B is a front view of an example hockey stick shaft 231 that includes a first curve 232 and a second curve 233. The example hockey shaft 231 includes an upper portion 234, a middle portion 235, and a lower portion 236. The example hockey shaft 231 has length L 237, and a midpoint 238 located at a distance of L/2 239 from a bottom 240 of the shaft 231. In the example of FIG. 4B, the lower portion 236 of the shaft 231 includes the midpoint 238 of the shaft 231. For example, the midpoint 238 of the shaft 231 is located between a top end 241 of the lower portion 236 of the shaft 231 and a bottom 240 of the shaft 231.

The examples above have described the midpoint of the shaft as being included in the middle portion of the shaft (see, e.g., FIG. 3 and corresponding discussion), in the upper portion of the shaft (see, e.g., FIG. 4A and corresponding discussion), or in the lower portion of the shaft (see e.g., FIG. 4B and corresponding discussion). In some examples, the first curve of the shaft may include the midpoint of the shaft, as will be described below with reference to FIG. 4C. In some examples, the second curve of the shaft may include the midpoint of the shaft, as will be described below with reference to FIG. 4D.

Figure 4C:
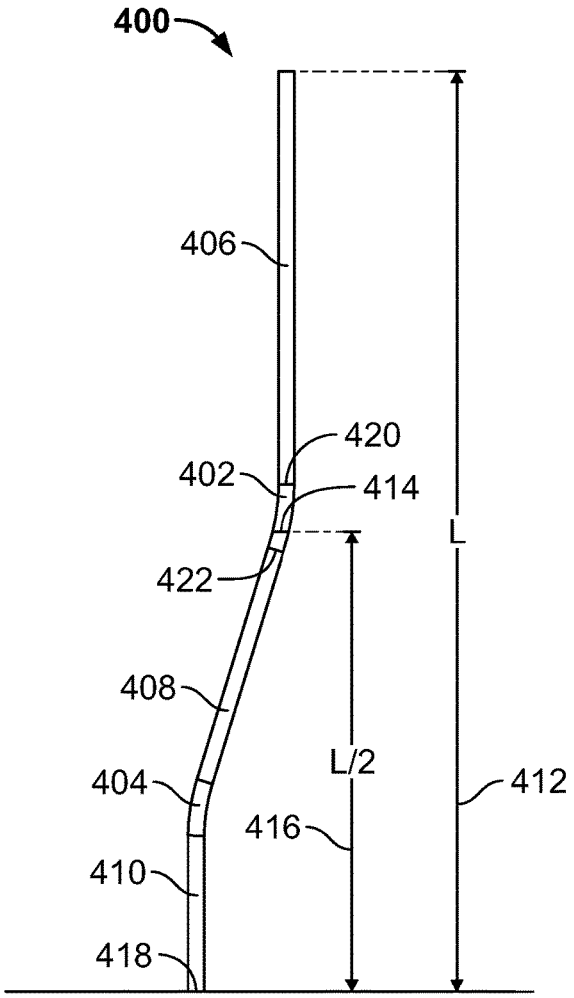

FIG. 4C is a front view of an example hockey stick shaft 400 that includes a first curve 402 and a second curve 404. The example hockey shaft 400 includes an upper portion 406, a middle portion 408, and a lower portion 410. The example hockey shaft 400 has length L 412, and a midpoint 414, at a distance of L/2 416 from a bottom 418 of the shaft 400. In the example of FIG. 4C, the first curve 402 of the shaft 400 includes the midpoint 414 of the shaft 400. For example, the midpoint 414 of the shaft 400 is located between a bottom end 420 of the upper portion 406 of the shaft 400 and a top end 422 of the middle portion 408 of the shaft 400.

Figure 4D:
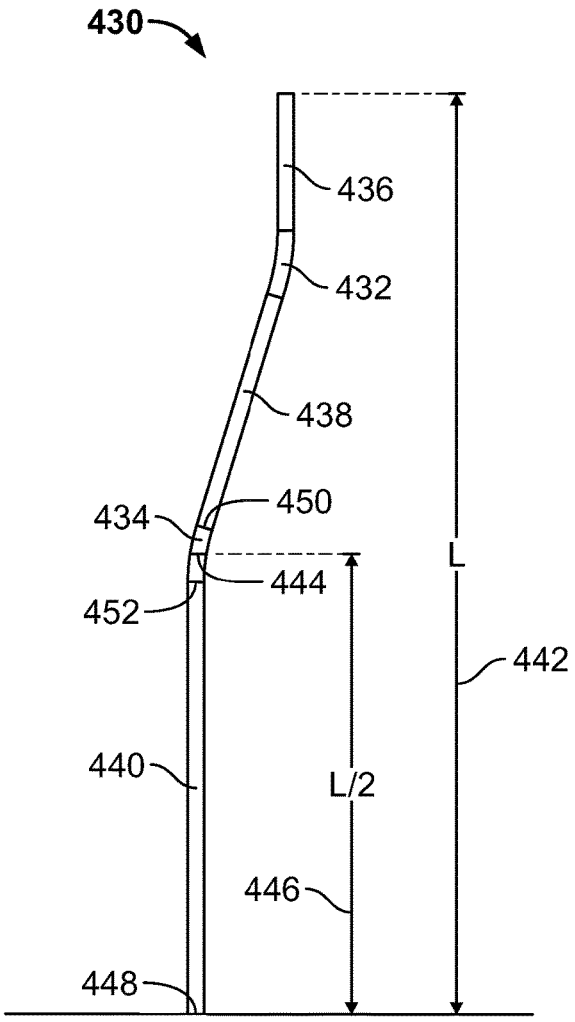

FIG. 4D is a front view an example hockey stick shaft 430 that includes a first curve 432 and a second curve 434. The example hockey shaft 430 includes an upper portion 436, a middle portion 438, and a lower portion 440. The example hockey shaft 430 has length L 442, and a midpoint 444 located at a distance of L/2 446 from a bottom 448 of the shaft 430. In the example of FIG. 4D, the second curve 434 of the shaft 430 includes the midpoint 444 of the shaft 430. For example, the midpoint 444 of the shaft 430 is located between a bottom end 450 of the middle portion 438 and a top end 452 of the lower portion 440 of the shaft 430.

The example hockey stick shafts described herein can be varied in numerous ways to suit personal preferences of the hockey skater. For example, one or more parameters of the shaft (e.g., length of the upper portion, middle portion, or lower portion, curvature of first curve or second curve, length of the first curve or second curve, or others) may be varied to provide a desired offset between the upper portion of the shaft and the lower portion of the shaft. Also, one or more parameters of the shaft (e.g., length of upper, middle, or lower portions, curvature of first curve or second curve, length of first curve or second curve, or others) may be varied to provide a desired angle of intersection between the upper portion and lower portion of the shaft (e.g., between axes defined by each portion). Further, one or more parameters of the shaft (e.g., length of upper, middle, or lower portions, curvature of first curve or second curve, length of first curve or second curve, type of material used to construct the shaft, or others) may be varied to provide a desired "kickpoint" for the shaft (e.g., low-kick point, mid-kick point, high-kick point). Further, one or more parameters of the shaft (e.g., length of upper, middle, or lower portions, curvature of first curve or second curve, length of first curve or second curve, type of material used to construct the shaft, or others) may be varied to provide a desired flexibility or flexibility rating for the shaft.

In some cases, a player's position may impact their shaft or stick preferences. Defensemen may typically take more slapshots during a game than do forwards, who may typically take more wrist-shots or snap-shots, for example, and such tendencies can impact personal stick preferences. Centers, as compared to defensemen or wingers, may be more concerned about how a shaft or stick performs during face-offs. Defensemen may prefer sticks with longer length, so that they can use the extra length to defend against opponents and potentially reach pucks that might otherwise be out-of-reach. Players who frequently stickhandle in tight spaces may prefer a stick or shaft with shorter length so that they can easier stickhandle with the puck close to their body. Each of the aforementioned factors, and others, can impact one's desired shaft or stick characteristics, for example.

Figure 5:
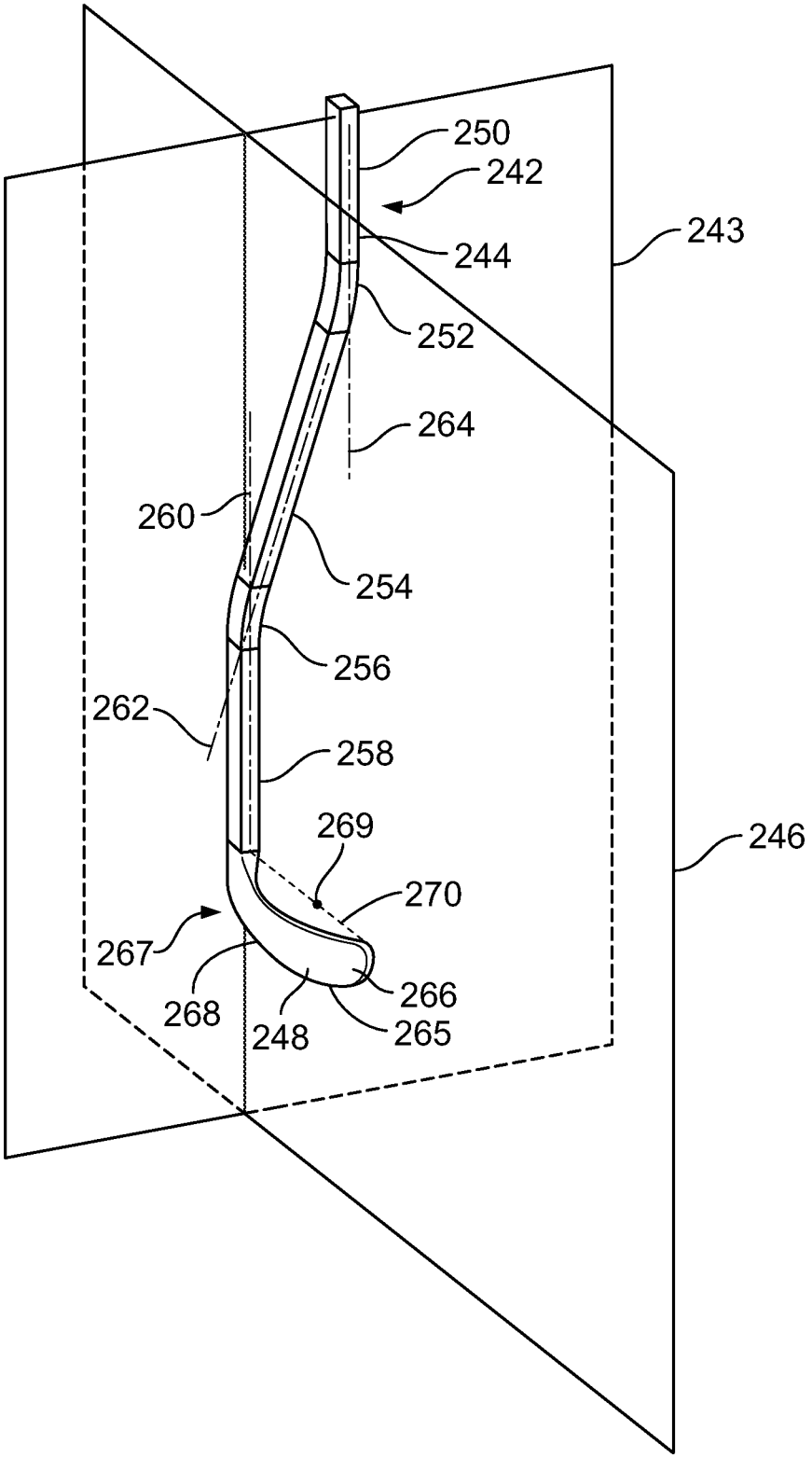
FIG. 5 is a perspective view of another example hockey stick, and a first plane associated with an example shaft of the hockey stick and a second plane associated with a blade of the hockey stick.

FIG. 5 is a perspective view of an example hockey stick 242, and a first plane 243 associated with an example shaft 244 of the hockey stick 242 and a second plane 246 associated with a blade 248 of the hockey stick 242. In the depicted example, the hockey stick 242 is a right-shot stick, but it will be understood that left-shot sticks could also be used. The shaft 244 includes an upper portion 250, a first curve 252, a middle portion 254, a second curve 256, and a lower portion 258. In various examples, the example hockey stick 242 may be the same as, or similar to, the hockey stick 120 described above with reference to FIGS. 2A, 2B, 2C, and 3, and the same or similar planes (that is, planes that are the same as, or similar to, planes 243 and 246) may be shown for the hockey stick 120 of FIGS. 2A, 2B, 2C, and 3 (not shown for simplicity).

In some examples, the first plane 243 is associated with one or more portions of the shaft 244 of the hockey stick 242. For example, the first plane 243 may be associated with the lower portion 258 of the shaft 244 and with the middle portion 254 of the shaft 244. In some examples, the first plane 243 may be defined by the lower portion 258 of the shaft 244 and by the middle portion 254 of the shaft 244. For example, a longitudinal axis 260 of the lower portion 258 and a point on a longitudinal axis 262 of the middle portion 254 may define the first plane 243, and may be contained within the first plane 243. In some examples, each of the longitudinal axis 260 of the lower portion 258 and the longitudinal axis 262 of the middle portion 254 is contained within the first plane 243.

In some examples, the first plane 243 may be associated with each of the upper portion 250 of the shaft 244, the middle portion 254 of the shaft 244, and the lower portion 258 of the shaft 244. For example, a longitudinal axis 264 of the upper portion 250, the longitudinal axis 262 of the middle portion 254, and the longitudinal axis 260 of the lower portion 258 may be contained within the first plane 243.

In some examples, the second plane 246 is associated with one or more portions of the blade 248 of the hockey stick 242. For example, the second plane 246 may be associated with a toe 265 of the blade 248 and with a heel 267 of the blade 248. In some examples, the second plane 246 may be defined by a midpoint 266 of the toe 265 of the blade 248, a midpoint 268 the heel 267 of the blade 248, and by a midpoint 269 of a secant 270 of a curve (or of a line) between a top of the toe 265 and a top of the heel 267 of the blade 248.

In some examples, the hockey stick 242 is configured such that the first plane 243 is generally transverse to the second plane 246. In some examples, the hockey stick 242 is configured such that the first plane 243 is substantially orthogonal to the second plane 246. In some examples, the hockey stick 242 is configured such that the first plane 243 is substantially perpendicular to the second plane 246. In some examples, the first plane 243 is offset about 90 degrees to the second plane 246.

Figure 6:
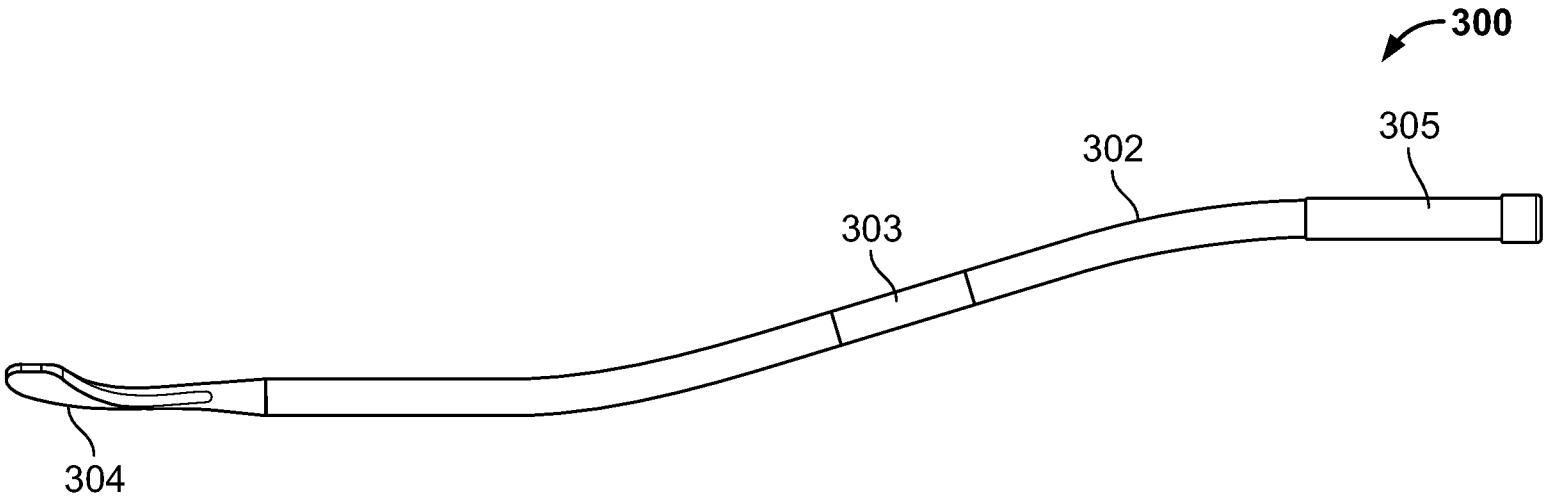
FIG. 6 is a front view of yet another example hockey stick.

FIG. 6 is a front view of an example hockey stick 300, where the stick 300 has been oriented generally horizontally for illustrative purposes. The example hockey stick 300 includes an example hockey shaft 302 and a blade 304 that extends from a lower portion of the shaft 302. In some examples, the shaft 302 may correspond to the shaft 122 or to the shaft 244 described above. The stick 300 is a "left-hand-shot" or "left-shot" stick, intended for use by players who grip the shaft 302 with their right hand near the top of the shaft and with their left hand lower on the shaft. The blade 304 figuratively curves "out of the page." As can be seen with reference to FIG. 6, the shaft 302 of the hockey stick 300 has a generally "S-shape." The shaft 302 includes an example grip feature 303 on a middle portion of the shaft 320, and an example grip feature 305 on an upper portion of the shaft 302.

Referring again to the hockey stick 120 of FIGS. 2A, 2B, 2C and 3, example shaft 122 includes four outer surfaces that extend the length of the example shaft 122: a front surface, a rear surface (opposite the front surface), a left surface, and a right surface (opposite the left surface). When viewed via a front view as in FIG. 2A, the front surface and rear surface may be planar surfaces (e.g., the front surface may be contained within a first plane (not shown) and the rear surface may be contained within a second plane (not shown)), but neither the left surface nor the right surface of the shaft 122 may be contained within a plane. For example, each of the left surface and the right surface of the shaft 122 may be a three-dimensional surface (e.g., in contrast to a two-dimensional surface), according to some implementations.

The hockey sticks described herein may be constructed of a variety of materials. Similarly, the hockey stick shafts described herein may be constructed of a variety of materials. In some examples, the hockey sticks discussed herein, or the shafts discussed herein, may be constructed of wood. In some examples, the hockey sticks discussed herein, or the shafts discussed herein, may be constructed of a metal such as, without limitation, aluminum or aluminum alloys, titanium or titanium alloys, or other appropriate metals or metal alloys. In some examples, the hockey sticks discussed herein, or the shafts discussed herein, may be constructed of a composite material. Without limitation, examples of composite materials that can be used can include fiberglass (e.g., arranged as a fiberglass weave or other arrangement), Kevlar or Aramid fibers (e.g., arranged as a Kevlar or Aramid weave or other arrangement), carbon fibre (e.g., arranged as a carbon fibre weave or other arrangement), graphite, various types of resins, or combinations of the foregoing. In some examples, the hockey sticks discussed herein, or the shafts discussed herein, may be constructed of a fiber-reinforced polymer. In some examples, the hockey sticks discussed herein, or the shafts discussed herein, may be constructed of a fiber-reinforced plastic.

In some examples, the hockey sticks described herein may be constructed with the shaft and the blade being integral with one another—i.e., as a one-piece hockey stick. In some examples, the hockey shafts described herein may be constructed independently from a hockey stick blade, and the blade may be thereafter attached to the shaft—i.e., to create a two-piece hockey stick. In some examples, the blade of the hockey stick may be detachable from the shaft of the hockey stick. In some examples the blade of the hockey stick may be releasably attachable to the shaft of the hockey stick.

Hockey sticks and hockey stick shafts have traditionally been offered in a variety of sizes. Hockey sticks and hockey stick shafts have also traditionally been offered in a variety of stiffnesses, sometimes referred to as the "flex" of the stick or shaft. For example, hockey sticks or hockey stick shafts may be offered in "Senior," "Intermediate," "Junior," or "Youth" sizes. In general, senior sticks will have a longer length and a stiffer flex than intermediate sticks, which will have a longer length and a stiffer flex than junior sticks, which will have a longer length and a stiffer flex than youth sticks. For a more customized fit, a purchaser may cut the shaft of the hockey stick to reduce the shaft length to an appropriate length. For shafts manufactured separately from the blade, a purchaser wishing to reduce a length of the shaft may cut an approximately equal amount from the upper portion and the lower portion to shorten the shaft to an appropriate length, in some examples. In other examples, a purchaser wishing to reduce a length of the shaft may cut a larger amount (or the entire amount) from either the upper portion or the lower portion. For any of the hockey sticks or hockey stick shafts discussed herein, the stick or shaft may be offered in a variety of sizes, and in a variety of flexes.

A player may grip any of the example hockey sticks (or shafts) described herein in a variety of ways. A player may typically grip the shaft with one hand on the upper portion of the shaft and the other hand on the middle portion of the shaft. In other examples (e.g., when taking a faceoff), the player may grip the shaft with one hand on the middle portion and the other hand on the lower portion. In some examples, the player may grip the shaft with one hand on the upper portion and the other hand on the lower portion. In some examples, each of the upper portion and the middle portion of the shaft can include a grip feature that can make it easier to hold the shaft in the area of the grip feature. In some examples, the lower portion of the shaft can also include a grip feature. In some examples, the first curve, the second curve, or both, can include a grip feature.

Without limitation, the grip feature can be one or more textured surfaces of the shaft, where a first area (or all) of the upper portion and a second area (or all) of the middle portion of the shaft include the one or more textured surfaces (e.g., each of the four surfaces of the shaft in the localized area). As another example, the grip feature can be a grip member, such as a rubber or plastic (or other appropriate material) grip member around the shaft in the area of interest. As yet another example, the grip feature can be tape wrapped around the shaft in the area of interest. In some examples, the grip feature can have one or more channels configured to engage with a player's fingers to make gripping the shaft easier.

Some implementations of the example hockey sticks, or hockey stick shafts, discussed herein can provide one or more advantages. For example, accuracy of shots (e.g., wrist shots, slapshots, snap-shots) may be improved, as the puck may remain in contact with the blade of the stick longer using the example hockey sticks or hockey stick shafts discussed herein. Because the upper portions and lower portions of the example shafts discussed herein are not collinear and include an offset between the upper and lower portions of the shaft (unlike a traditional hockey stick, where the entire shaft is linear, for example), the example sticks and shafts described herein may provide an improved lever action as compared to a traditional stick or shaft. This improved lever action may provide improved accuracy on forehand-based shots (e.g., wrist-shot, slapshot, snap-shot) in some implementations. The improved lever action may also provide improved accuracy when making passes in some implementations.

As another example of an advantage that can be provided by some implementations of the hockey sticks or shafts discussed herein, pass receiving may also be improved, for example because the stick (or the blade of the stick) may be less likely to deflect or flare when a pass is received, thereby reducing a likelihood that the puck may glance off the blade when receiving a pass. For example, the improved lever action discussed above may provide a counterbalance to the torque applied at the blade of the stick when a puck is received, which may reduce a tendency for the blade to deflect as compared to a blade on a traditional hockey stick with a straight shaft. Because the sticks and shafts described herein may be configured to reduce the tendency of the blade to deflect offline when incident torque of a received puck is applied to the blade of the stick, a more stable pass-receiving platform may be provided, which may result in fewer turnovers.

As yet another example of an advantage that can be provided by some implementations of the hockey sticks or shafts discussed herein, stickhandling (e.g., controlling the puck while moving forward, backward, laterally, or remaining stationary) may also be improved. For example, the example hockey sticks and hockey stick shafts discussed herein may make it easier and more comfortable to control the puck in a position neutral to the body of the player (e.g., generally centered relative to the player's stance) as compared to a hockey stick with a traditional (straight) shaft.

Figure 7A:
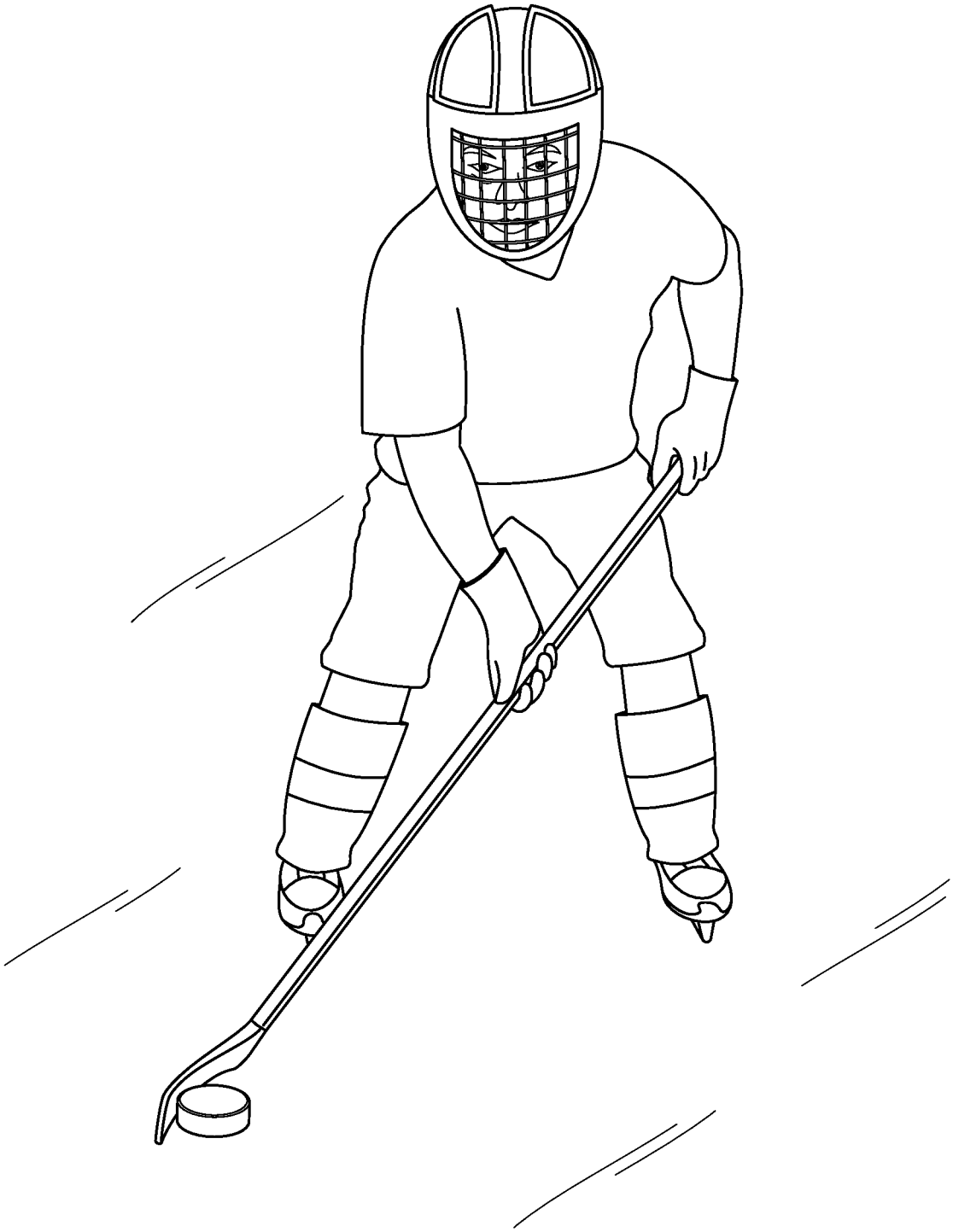
FIG. 7A is a front view of a player using a traditional hockey stick.

FIG. 7A is a front view of a hockey player using a traditional hockey stick with a traditional (straight) shaft. As can be seen in FIG. 7A, as the player assumes a generally neutral hockey position with the traditional stick, the blade of the stick is positioned off to the side of the player's stance, so that when the player controls a puck from this stance, such puck control will also occur off to the side of the player's stance. Were the player in FIG. 7A to move the puck to a more centered position closer to the center of the player's stance with the traditional stick, the player would either have to move his arms to his left and generally to the side of this body (a less natural position), or extend his arms in toward his body, causing the blade of the stick to extend further from his body, which might make it more difficult to protect the puck from an opponent because the puck may be further from the player's body and the player may be less able to shield the puck from an opponent.

Figure 7B:
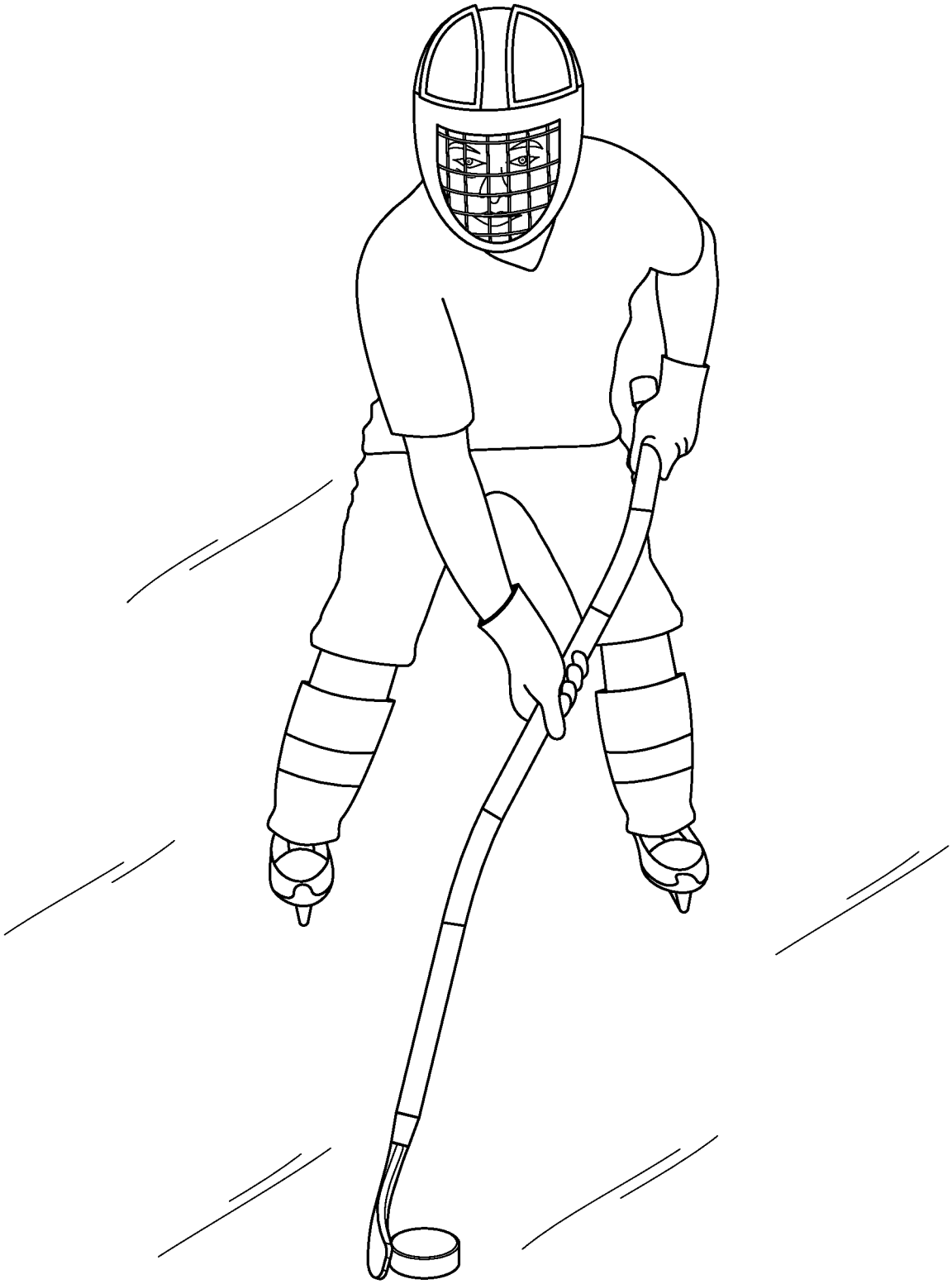
FIG. 7B is a front view of a player using the example hockey stick of FIGS. 2A, 2B, and 2C.

FIG. 7B is a front view of a hockey player using the example hockey stick 120 with the shaft 122 that includes first and second curves 124 and 126, respectively. As can be seen in FIG. 7B, as the player assumes a generally neutral hockey position with the example stick 120, the blade the stick is positioned generally in the center of the players stance, so that when the player controls a puck from this stance, such puck control will also occur generally in a neutral position in the center of the player's stance. As can be seen when comparing FIG. 7A and FIG. 7B, where in each case the player assumes a generally neutral hockey position, the resulting puck position is generally in the center of the player's stance when using the example stick 120 of FIG. 7B, in contrast to the resulting puck position off to the side of the player's stance when using the traditional hockey stick of FIG. 7A. Referring again to FIG. 7B, because the stick 120 can be configured to provide for improved neutrality with puck position (e.g., closer to the center of the player's stance while assuming a neutral hockey position) while stickhandling, it may be easier for the player to carry or stickhandle the puck to the left or to the right from the depicted neutral position. Additionally, the player may be better able to survey the ice, which may lead to better awareness, when controlling the puck from a neutral position, as the puck may better remain in his peripheral vision as he looks ahead or to the side (e.g., versus the puck being generally off to his side when controlling the puck from a neutral position using a traditional stick). Further, the player may be able to better protect the puck from opponents, as it may be easier to shield the puck with one's body when controlling the puck in a more neutral position versus the puck being off to one side, for example. In some examples, making a backhand pass or shot (or a forehand pass or shot) may be easier using the hockey stick 120 as compared to a traditional stick because of the more neutral position of the puck in the center of the player's stance (see e.g., FIG. 7B) as compared to the offset position of the puck with a traditional stick (see e.g., FIG. 7A). Further to the potential advantages related to backhand shots or passes (e.g., saucer passes), with some implementations, it may be easier to lift the puck off the ice with a backhand shot. This potential advantage may be provided, for example, by the offset feature of the upper and lower portions of the shaft, and because of the more neutral puck handling position that the design enables, as discussed above.

As yet another example of an advantage that can be provided by some implementations of the hockey sticks or shafts discussed herein, a variety of potential hand positions may be provided along the shaft, or along straight portions or curved portions of the shaft. For example, a player may place his hands on one or more of the upper portion, middle portion, or lower portion of the shaft, or in some examples on the first curve or the second curve of the shaft. By placing a hand on the middle portion of the shaft, for example, the player may be better able to apply a downward force because of the relatively more horizontal orientation of the middle portions as compared to a straight traditional hockey shaft when held in a typical hockey position, for example. If desired, for example, the player may more easily impart a downward force on the stick into the ice, which may improve performance during puck-battles with an opponent, for example. Additionally, it may be more difficult for an opponent to knock the stick out of the player's hand, or may be more difficult for an opponent to lift the player's stick off the ice, each of which may provide improved performance in various situations.

With some implementations, a player may additionally get improved faceoff performance using the example hockey sticks and shafts discussed herein. For example, the player may position hands on the middle portion and the lower portion when taking a faceoff. The blade of the stick may better remain square or perpendicular to the ice, which may make it easier for the player to pull the puck backwards on the faceoff draw. The non-collinear feature of the middle and lower portions of the stick may also provide an improved lever action with the example stick, which may improve the player's ability to win the faceoff.

As yet another example of an advantage that can be provided by some implementations of the hockey sticks or shafts discussed herein, in some implementations a higher percentage of the energy provided by a player's shooting motion may be provided in the direction of the shot, which may provide increased shot velocity in some implementations. In some examples, the player may be able to generate a stronger shot because of the more neutral body position provided by some implementations of the sticks and shafts discussed herein.

As yet another example of an advantage that can be provided by some implementations of the hockey sticks or shafts discussed herein, because of the nonlinear shape of the stick, it may be easier and quicker for a player to pick up a dropped stick from the ice.

Referring again to FIGS. 2A-2C, in some examples, the shaft may not include the first curve 124, and the upper portion 128 and middle portion 130 may be arranged to be collinear with one another. For example, the first curve may be replaced with a straight portion of the shaft connecting the upper portion with the middle portion, so that the upper and middle portions are essentially a longer, straight portion that transitions, via the second curve, to the lower portion of the shaft.

Figure 8A:
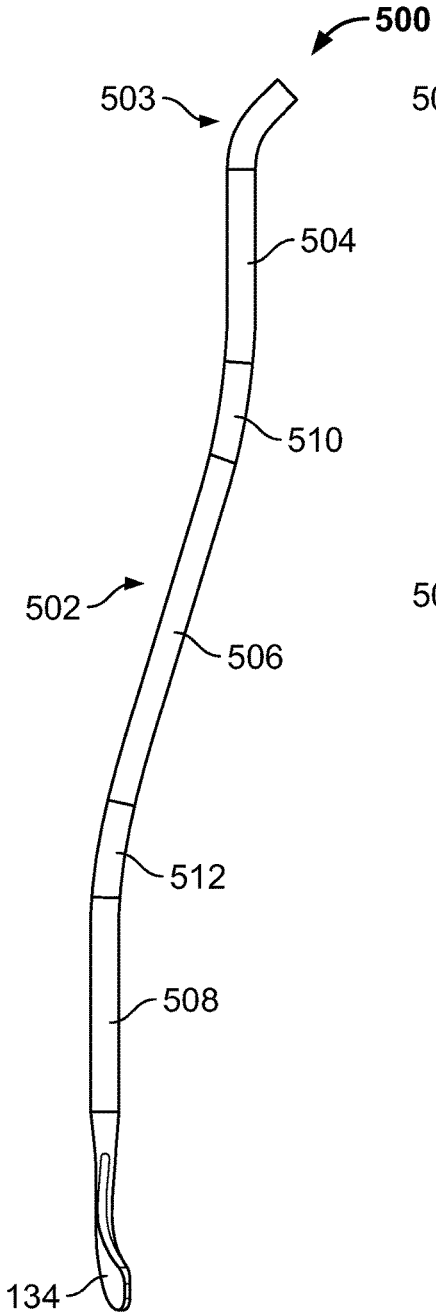
FIGS. 8A, 8B, and 8C are a front view, a side view, and a top view, respectively, of another example hockey stick.
Figure 8B:
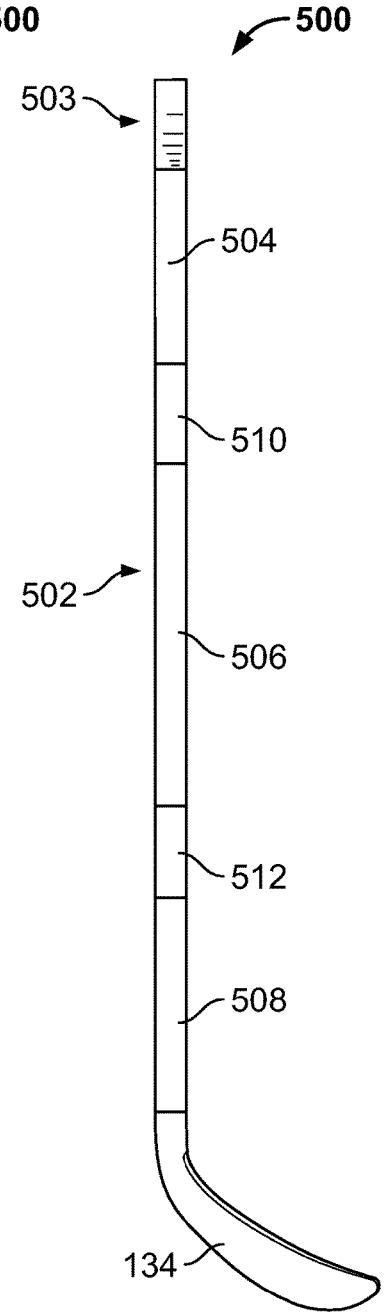
Figure 8C:
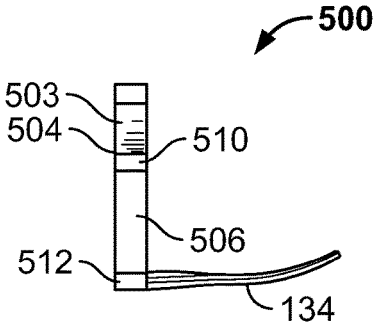

FIGS. 8A, 8B, and 8C are a front view, a side view, and a top view, respectively, of another example hockey stick 500 that includes an example hockey stick shaft 502 and a blade 134. The hockey stick 500 is similar to the hockey stick 120 of FIGS. 2A-2C, but includes a third curve 503 on an upper portion 504 of the shaft 502. The shaft 502 includes a middle portion 506, a lower portion 508, a first curve 510 and a second curve 512, which may respectively be the same or similar to the middle portion 130, the lower portion 132, the first curve 124 and the second curve 126 of the shaft 122 of FIGS. 2A-2C. The depicted blade 134 is curved to the right when viewed via a front view (e.g., FIG. 8A), and stick 500 is thus a right-shot stick.

The third curve 503 may be located at or near the top of the upper portion 504 and may provide a slight forward curve at the top of the upper portion 504, as can be seen with reference to the top view of FIG. 8C. With reference to the side view of FIG. 8B, the third curve 503 may be figuratively "into the page."

Figure 9:
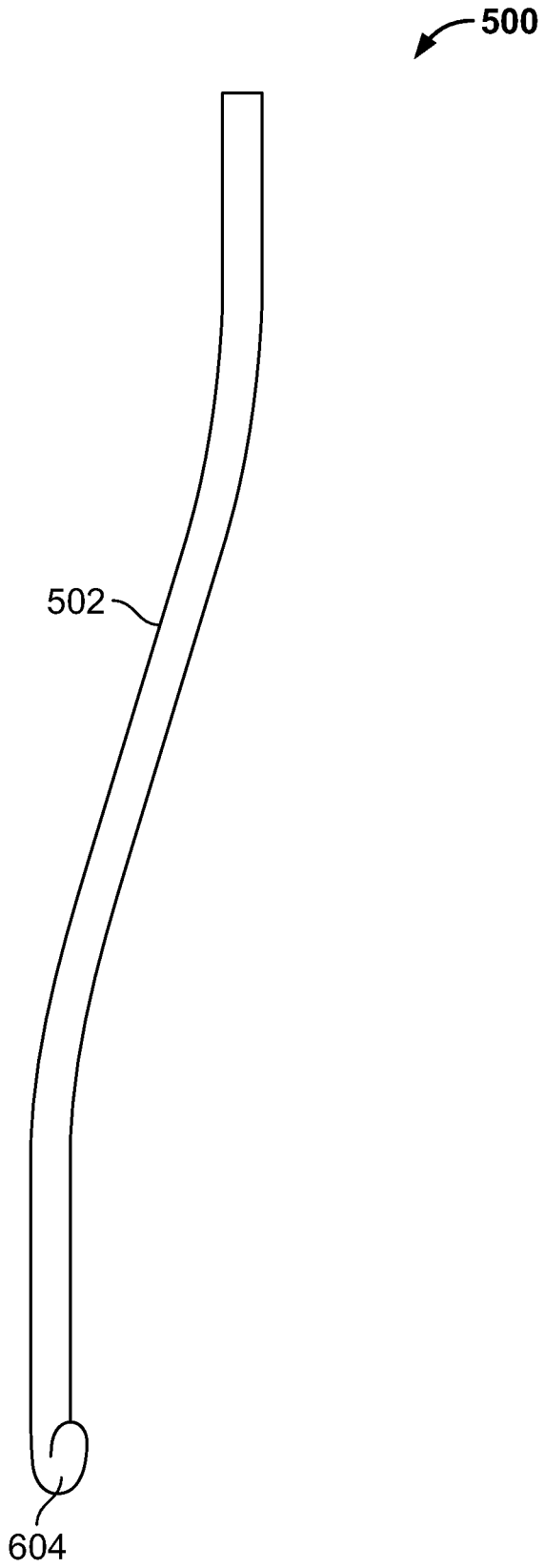
FIG. 9 is a perspective view of an example field hockey stick.

FIG. 9 is a perspective view of an example field hockey stick 500. Example field hockey stick 500 includes an example shaft 502 that includes a first curve and a second curve, and in general the shaft 502 may have a shape that is the same or similar to shaft 122 of FIGS. 2A-2C, for example. Example field hockey stick 500 includes a field hockey blade 604 that extends from a lower portion of the example shaft 502.

The above description provides examples of some implementations. Other implementations that are not explicitly described above are also possible, such as implementations based on modifications and/or variations of the features described above. For example, the techniques described above may be implemented in different orders, with the inclusion of one or more additional steps, and/or with the exclusion of one or more of the identified steps. Similarly, the apparatuses described herein may include one or more additional features, may exclude one or more of the identified features, and/or include the identified features combined in a different way than presented above. Features that are described as singular may be implemented as a plurality of such features. Likewise, features that are described as a plurality may be implemented as singular instances of such features. The drawings are intended to be illustrative and may not precisely depict some implementations. Variations in sizing, placement, shapes, angles, curvatures, and/or the positioning of features relative to each other are possible.

What is claimed is:

1. A hockey stick, comprising:

a shaft that includes an upper portion, a lower portion, and a middle portion between the upper portion and the lower portion, wherein the upper portion transitions to the middle portion via a first curve, and wherein the middle portion transitions to the lower portion via a second curve; and a blade that extends from the lower portion and that has a curvature to define a forehand direction and a backhand direction;

wherein, when the hockey stick is viewed from a viewing position with the blade generally extending toward the viewing position, the lower portion of the shaft is laterally offset in the backhand direction from the upper portion of the shaft, the offset in the backhand direction provided by the first curve, the middle portion of the shaft, and the second curve, and wherein the upper portion is nonlinear with, and substantially parallel to, the lower portion; and wherein a midpoint of the shaft along a length dimension of the shaft is included in at least one of the lower portion, the second curve, the middle portion, and the first curve, and wherein the first curve is in a first direction and the second curve is in a second direction that is generally opposite the first direction.

2. The hockey stick of claim 1, wherein the middle portion includes a midpoint of the shaft.

3. The hockey stick of claim 1, wherein the lower portion includes a midpoint of the shaft.

4. The hockey stick of claim 1, wherein the second curve includes a midpoint of the shaft.

5. The hockey stick of claim 1, wherein the shaft has a generally S-shape.

6. The hockey stick of claim 1, wherein the shaft is constructed of wood, metal, or composite material.

7. The hockey stick of claim 1, wherein the shaft is constructed of a material selected from the group consisting of aluminum, aluminum alloy, titanium, titanium alloy, fiberglass, Kevlar, Aramid material, carbon fibre, graphite, resin, fiber-reinforced polymer, and fiber-reinforced plastic.

8. The hockey stick of claim 1, wherein each of the upper portion, middle portion, and lower portion are substantially straight.

9. The hockey stick of claim 1, wherein the upper portion includes a first grip feature, and wherein the middle portion includes a second grip feature.

10. The hockey stick of claim 9, wherein the lower portion includes a third grip feature.

11. The hockey stick of claim 1, wherein the upper portion includes a transverse curve near an end of the upper portion.

12. The hockey stick of claim 1, wherein the blade is releasably attached to the shaft.

13. The hockey stick of claim 1, wherein the first curve or the second curve includes two or more contiguous and straight shaft portions that define one or more angles between the two or more contiguous and straight shaft portions.

14. A hockey stick, comprising:

a shaft that includes an upper portion, a lower portion, and a middle portion between the upper portion and the lower portion, wherein the upper portion transitions to the middle portion via a first curve, and wherein the middle portion transitions to the lower portion via a second curve; and a blade that extends from the lower portion and that has a curvature to define a forehand direction and a backhand direction;

wherein, when the hockey stick is viewed from a viewing position with the blade generally extending toward the viewing position, the lower portion of the shaft is laterally offset in the backhand direction from the upper portion of the shaft, the offset in the backhand direction provided by the first curve, the middle portion of the shaft, and the second curve, and wherein the upper portion is nonlinear with, and substantially parallel to, the lower portion; and wherein a midpoint of the shaft along a length dimension of the shaft is included in at least one of the lower portion, the second curve, the middle portion, and the first curve, and wherein a longitudinal axis of the upper portion and a longitudinal axis of the lower portion intersect at an angle within a range of 0 degrees to 45 degrees.

15. A hockey stick, comprising:

a shaft that includes an upper portion, a lower portion, and a middle portion between the upper portion and the lower portion, wherein the upper portion transitions to the middle portion via a first curve, and wherein the middle portion transitions to the lower portion via a second curve, and wherein the middle portion includes a midpoint of the shaft along a length dimension of the shaft; and a blade that extends from the lower portion and that has a curvature to define a forehand direction and a backhand direction;

wherein the lower portion of the shaft is laterally offset in the backhand direction from the upper portion of the shaft due to the first curve, the middle portion of the shaft, and the second curve such that the upper portion is positioned further in the forehand direction than both the blade and the lower portion, and wherein the upper portion is nonlinear with, and substantially parallel to, the lower portion.

16. A hockey stick, comprising:

a shaft that includes an upper portion, a lower portion, and a middle portion between the upper portion and the lower portion, wherein the upper portion transitions to the middle portion via a first curve, and wherein the middle portion transitions to the lower portion via a second curve; and a blade that extends from the lower portion;

wherein, when the hockey stick is viewed from a viewing position with the blade generally extending toward the viewing position, the lower portion of the shaft is offset in a lateral direction from the upper portion of the shaft, the offset in the lateral direction provided by the first curve, the middle portion of the shaft, and the second curve, and wherein the upper portion is nonlinear with, and substantially parallel to, the lower portion; and wherein a midpoint of the shaft along a length dimension of the shaft is included in at least one of the lower portion, the second curve, the middle portion, and the first curve; and wherein the hockey stick is a one-piece hockey stick, and wherein the middle portion includes a midpoint of the shaft.

* * * * *